US006443217B1

(12) United States Patent
May

(10) Patent No.: US 6,443,217 B1
(45) Date of Patent: Sep. 3, 2002

(54) APPARATUS FOR PRODUCING CAST METAL ARTICLES AND PROCESS

(75) Inventor: Charles B. May, Hot Springs, AR (US)

(73) Assignee: Superior Industries International, Inc., Fayetteville, AK (US)

( * ) Notice: Subject to any disclaimer, the term of this patent is extended or adjusted under 35 U.S.C. 154(b) by 0 days.

(21) Appl. No.: 09/802,789

(22) Filed: Mar. 8, 2001

Related U.S. Application Data

(60) Provisional application No. 60/189,607, filed on Mar. 15, 2000.

(51) Int. Cl.[7] ..... B22D 33/04; B22D 17/26; B22C 9/28

(52) U.S. Cl. ..... 164/340; 164/342; 164/343; 249/56

(58) Field of Search ..... 164/339, 340, 164/341, 342, 343, 344, 345, 346, 137, DIG. 14; 249/56

(56) References Cited

U.S. PATENT DOCUMENTS

| | | | | | |
|---|---|---|---|---|---|
| 4,301,856 | A | | 11/1981 | DiRosa | 164/340 |
| 4,986,335 | A | | 1/1991 | Koch | 164/312 |
| 5,205,339 | A | | 4/1993 | Perrella | 164/113 |
| 5,246,059 | A | | 9/1993 | Sulprizio | 164/343 |
| 5,311,918 | A | * | 5/1994 | Scott | 164/63 |
| 5,325,908 | A | * | 7/1994 | Sugishima | 164/341 |
| 5,427,171 | A | * | 6/1995 | Prieto | 164/132 |
| 5,605,187 | A | | 2/1997 | Perrella et al. | 164/342 |
| 5,626,182 | A | | 5/1997 | Bortoloni | 164/340 |
| 5,810,067 | A | * | 9/1998 | Atari et al. | 164/120 |
| 5,810,068 | A | * | 9/1998 | Kato | 164/306 |
| 5,865,241 | A | | 2/1999 | Bishenden et al. | 164/137 |
| 5,896,912 | A | | 4/1999 | Monroe et al. | 164/134 |
| 6,186,218 | B1 | * | 2/2001 | Prieto | 164/339 |
| 6,318,446 | B1 | * | 11/2001 | Nichols et al. | 164/337 |

OTHER PUBLICATIONS

"Casting Machines" 4–page website article of Empire Castings Inc. (www.empirecastings.com Mar. 3, 2000).

* cited by examiner

*Primary Examiner*—M. Alexandra Elve
*Assistant Examiner*—Kevin P. Kerns
(74) *Attorney, Agent, or Firm*—Head, Johnson & Kachigian; Robert R. Keegan

(57) ABSTRACT

A casting apparatus for vehicle wheels includes a bottom core or face core mold segment affixed to a stationary bed and a top core mold segment affixed to a vertically movable head; a pivotally mounted side mold positioning arrangement of minimal bulk and mass is provided for each of the four, or greater number of side molds. Side mold segments are each connected by a linkage to the movable head to move vertically upwardly and downwardly while permitting independent lateral, typically arcuate, movement. Actuators in the form of hydraulic, pneumatic, or other linear actuators for each of the side mold segments are controlled to move each segment inwardly or outwardly; electro-mechanical or pneumatic actuators could alternatively be employed. A locator ring latching mechanism is provided for retaining the side cores in closed position which engages tabs on the bottom of the side cores to seat on and seal with the bottom core.

19 Claims, 5 Drawing Sheets

APPARATUS FOR PRODUCING CAST METAL ARTICLES AND PROCESS

CROSS REFERENCE TO RELATED APPLICATIONS

This application claims priority to provisional application serial No. 60/189,607, filed Mar. 15, 2000.

TECHNICAL FIELD

The present invention relates to metal casting apparatus and particularly to the portion of such apparatus and the method for positioning side mold segments in a first position to form a closed mold cavity and in a second position facilitating separation of a top core mold segment and a bottom core mold segment to release the cast article from the mold. The field of the invention particularly includes machines and apparatus for casting of vehicle wheels formed by gravity or pressure feeding molten metal into a multi-piece wheel mold that defines the mold cavity.

BACKGROUND OF THE INVENTION

The present invention involves a form of metal casting particularly useful for casting vehicle wheels but also adaptable for use in casting other products particularly those with a predominantly circular cross-section. In a common form of such apparatus a multi-piece wheel mold consists of the following parts:

A face core which defines the outward face of the wheel, which one sees when the wheel is in an installed position; a top core which defines the inboard or brake side of the wheel; and the side cores (side mold segments), three or more in number which define what is commonly referred to as the rim of the wheel.

A typical mold contains one each top core and bottom core and four, five or six side cores. Each of these side cores are mounted in a core box which positions, moves and locks each side core in place by means of hydraulic or other actuators controlled by an electronic control system. In conventional casting apparatus known and used prior to the present invention, there was an extensive mass of apparatus used to position, slideably move and lock in place the side cores which form the rim portion of an automotive wheel. Such conventional casting apparatus to which the present invention is an improvement includes wheel casting machines using pressure feeding manufactured by Empire Castings Corporation (and disclosed at www.empirecastings.com). For known conventional wheel casting machines, one may also note U.S. Pat. No. 5,896,912 to Monroe, et al., entitled Method and Apparatus for Casting of Vehicle Wheel in a Pressurized Mold issued Apr. 27, 1999. The disclosures of the Monroe, et al. patent and the Empire Casting apparatus are incorporated by reference herein as an example of an apparatus and method known in the art to which the present invention is an improvement.

Prior apparatus for casting vehicle wheels and the like as discussed above have often employed massive and bulky core boxes for slideably moving and locking side cores in place, this makes it inherently difficult to facilitate and control the cooling of the portion of the side cores, particularly those that are in contact with the molten metal in the casting process. The massive, bulky core box structure also requires a larger overall casting apparatus with wider spaced columns for supporting and guiding the movable head which raises and lowers the top core mold apparatus. Furthermore, the core box arrangement in use prior to the present invention is deficient in accurately restraining and locking the side core molds relative to the top core mold and the bottom core mold thereby increasing a likelihood of unacceptable eccentricity in the vehicle wheel. Clearly, the highest degree of concentricity in a wheel casting is of utmost importance.

SUMMARY OF THE INVENTION

The present invention departs from the teaching of prior art apparatus and methods for casting of vehicle wheels primarily by providing improved apparatus and method for placing and displacing the multiple side mold segments forming a part of the mold cavity whereby a mold of greater integrity and accuracy of formation is achieved while at the same time reducing the bulk of the structure. Accordingly, the improved apparatus of the invention facilitates cooling by controlling uniform thickness of the mold sidewall while also eliminating the large bulk and mass of the prior art core box structure. Elimination of the core box structure with horizontal linear actuators makes it possible to reduce the overall size of the metal casting apparatus unit because the overall wheel casting unit size has been determined primarily to accommodate such core box structures. Metal casting apparatus for vehicle wheels or the like incorporating the present invention are generally similar to prior apparatus in that they include a bottom core or face core mold segment adapted to be affixed to a stationary bed of the casting apparatus and a top core mold segment adapted to be affixed to a vertically movable head of the casting apparatus. Rather than employing the conventional core box structures to move the multiple side mold segments (typically four in number) horizontally inward for closing the mold cavity and horizontally outward for opening the mold, a novel pivotally mounted side mold positioning and locking arrangement of minimal bulk and mass is provided by the present invention.

The side mold segments are each connected by a linkage to the movable head to cause them to move vertically upwardly and downwardly with the movable head while permitting independent lateral movement, typically arcuate movement about a pivot axis at or above the level of the top core mold segment. Actuators for each of the side mold segments are controlled to move each of the segments inwardly or outwardly to close or open the mold. Such actuators may typically be in the form of hydraulic cylinders pivotally connected at the cylinder connecting head to the movable head of the casting apparatus and having the cylinder pull-arm connected for producing pivotal motion of the side mold between a mold closing and a mold opening position. Other forms such as electromechanical or pneumatic actuators could alternatively be employed. In the preferred example described herein, it is advantageous to provide a latching mechanism for retaining the side cores in closed position in the form of a locator ring which engages arcuate tabs on the bottom of the side cores as the top core and side cores reach their limit of movement to seat on and seal with the bottom core. This gives great structural integrity to the mold assembly and assures great accuracy in positioning of the side cores which is important for maximizing concentricity of the wheel casting.

Among the objects and advantages of the present improved metal casting apparatus for vehicle wheels and other articles are the following:

The apparatus eliminates the present core box apparatus that horizontally moves and locks the side cores which is replaced by much less bulky structure, and eliminates former high repair and maintenance costs for this apparatus.

The apparatus frees up space in the lower area of the casting machine, allowing for redesign of smaller, potentially more economical casting machines to produce castings.

The apparatus provides for greater accessibility to all mold components during operation.

The improved apparatus eliminates prior mechanism to break side cores free from the outside rim area of the casting.

The side cores employed with the apparatus are of less complexity and hence their cost is reduced.

Initial mold cost for the apparatus is reduced by eliminating interlocks between the top core and face core and reducing the maintenance costs for those interlocks.

The apparatus provides significantly improved overall core concentricity, which will in turn improve the finished product and allow for less finishing stock on the casting, thereby providing advantages in material costs and processing costs.

The elimination of the prior core box horizontal positioning apparatus will significantly enhance the ability to further automate the simplified casting operation.

The apparatus according to the invention allows more freedom in mold wall design, particularly thickness and uniformity, and it allows more efficient cooling. This enhances the ability to promote controlled progressive solidification of the wheel. This will result in the formation of relatively smaller sized grains in the crystalline structure of the castings and improvement in the dendritic arm spacing of the finished product. This will in turn promote enhanced fatigue performance in the product and allow for the design of a more structurally efficient product.

In summary, this invention relates to an improved wheel casting apparatus, which will allow for significant saving in both material and process costs during the casting of a wheel. In addition, it will allow for enhanced controlling of the cooling process of the molten metal, forming a wheel superior in performance characteristics to wheels produced using the prior art. Faster and more controlled cooling results in an improved wheel casting having a finer grain size, increased strength, and reduced porosity. This turn will allow a reduction in finished product weight and in the material initially required to cast the wheel. Faster cooling will also allow for higher production rate. The invention's features, at least in part, are adapted for use in providing improvements to casting apparatus for metal articles other than wheels.

In addition to the features and advantages of the improved metal casting apparatus according to the invention described above, further advantages thereof will be apparent from the following description in conjunction with the appended drawings.

DETAILED DESCRIPTION OF THE PREFERRED EMBODIMENTS

Figure 1:
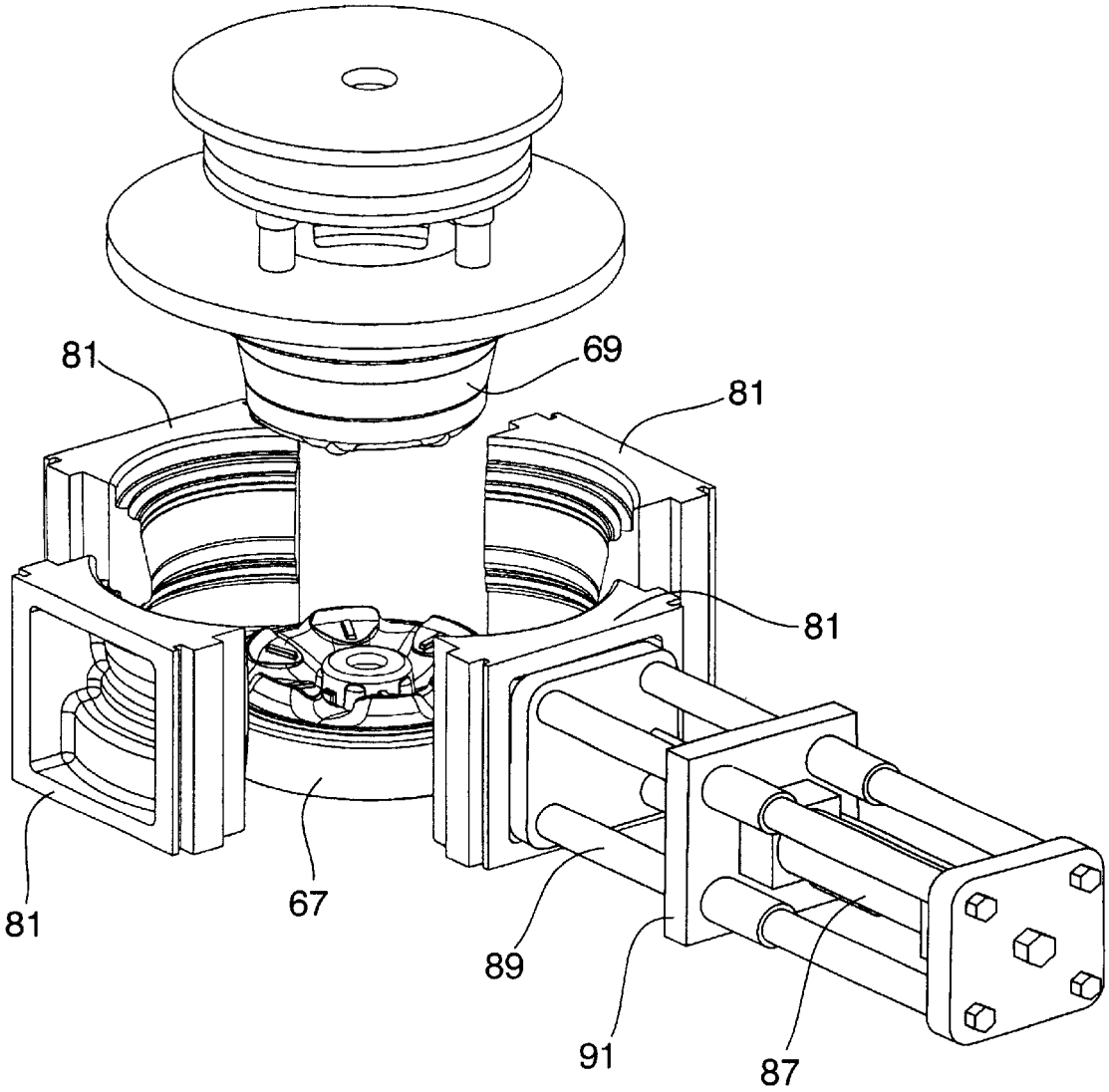
FIG. 1 PRIOR ART
FIGS. 1 and 1A are illustrations of the prior art.
Figure 1A:
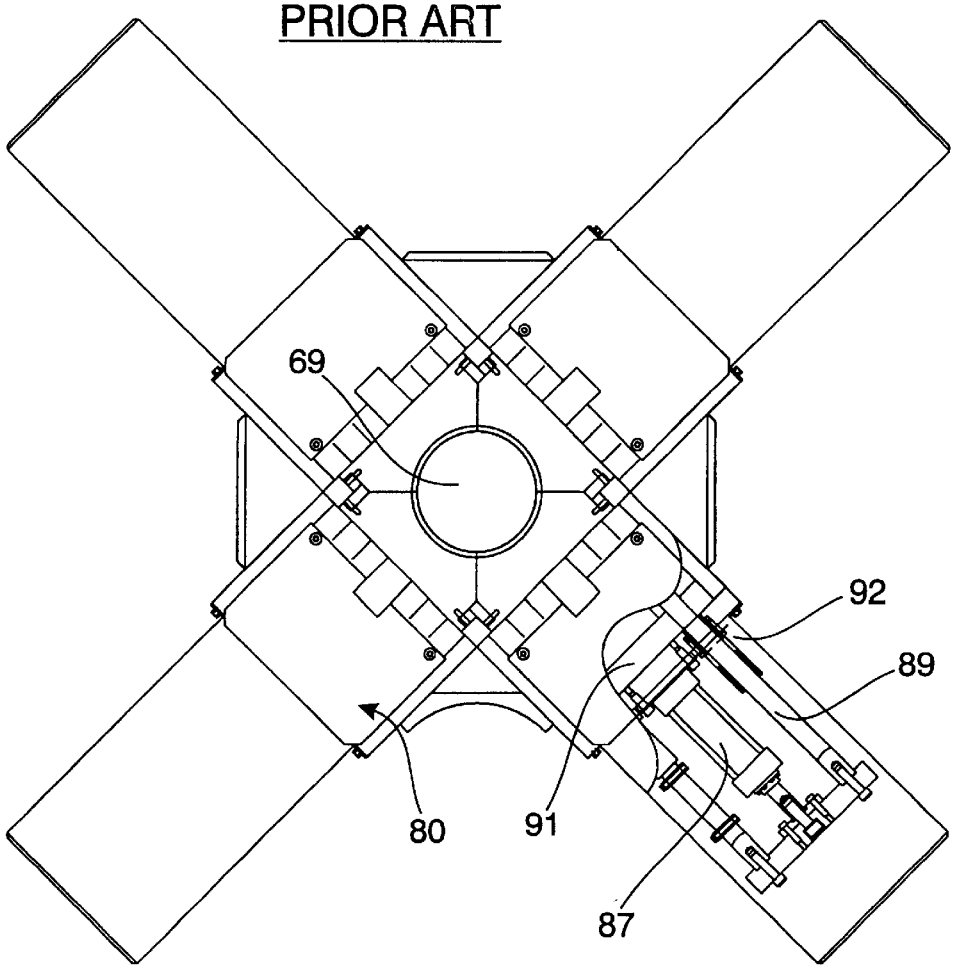
FIG. 1A PRIOR ART

Referring to the drawings, FIGS. 1 and 1A show prior art apparatus for producing cast metal articles for which the present invention is an improvement particularly in regard to the mechanism for positioning and moving side mold segments (also referred to as side cores). As shown in FIG. 1, each side core 81 is of the form designed to be mounted in a core box as shown in FIGS. 1 and 1A (the entire core box structure is not shown in FIG. 1 for clarity of illustration). In FIG. 1, a bottom core 67 also referred to as a face core is shown as it would be positioned on the bed of the overall casting structure. Top core 69 is concentrically placed above face core 67 and is shown in the open position. Each side core 81 is also shown in the retracted, open position so that the mold segments shown are positioned to release a cast wheel to complete the casting operation. Each side core 69 has associated therewith a separately actuated lock (not shown). Such a lock is required to hold side core 69 in place against the force exerted by the pressurized molten metal in the casting process. Note FIGS. 1 and 1A show the massive side mold positioning and moving mechanism of the core box arrangement 80 for the four side cores. The side cores which are in themselves rather massive are secured to mounting plates 91 which are slidably guided by shafts 89 in guide blocks 92 and are pushed in to close the mold or pulled out from top core 69 to open the mold by hydraulic actuators 87.

An important factor in mold design is the ability to control the temperatures of the portions of the mold and hence to control the cooling of the cast article. In general, it is desirable to avoid very slow cooling or unintended uneven cooling of various parts of the mold and consequently of various parts of the cast article. The prior art core box apparatus 80 as shown in FIG. 1A with its massive construction makes it difficult to provide apparatus to control the cooling of the side mold segments and otherwise inhibits access to the mold parts while the apparatus is operating. Often liquid or gaseous cooling fluids are directed through hoses to the molds, but hoses or other means for cooling have not been shown in the drawing for simplicity and clarity.

Figure 2:
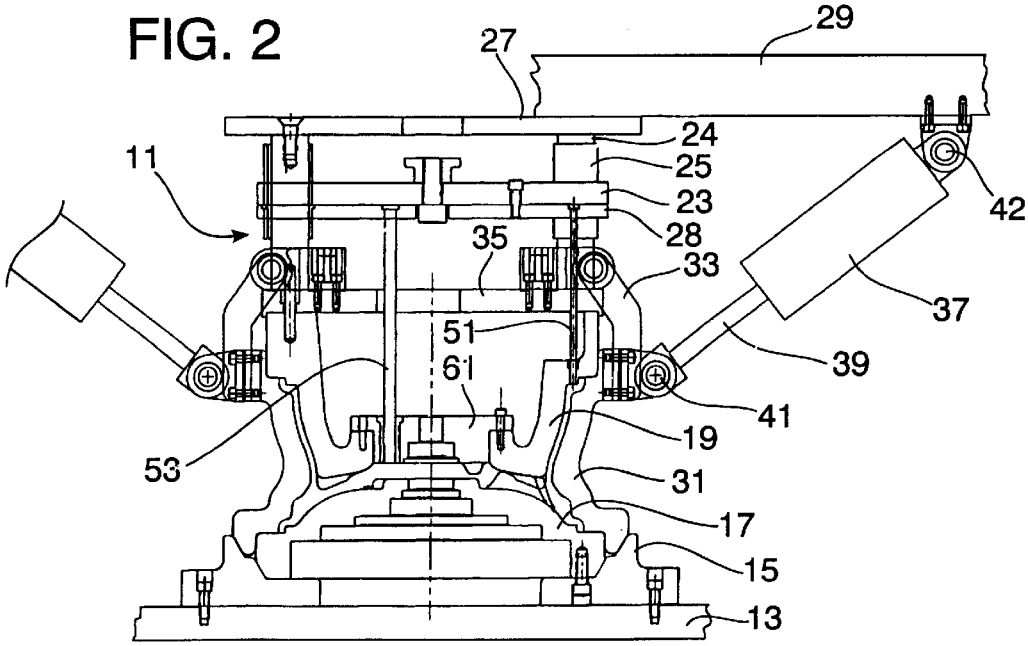
FIG. 2 is partially schematic, broken away view of casting apparatus according to the invention.
Figure 3:
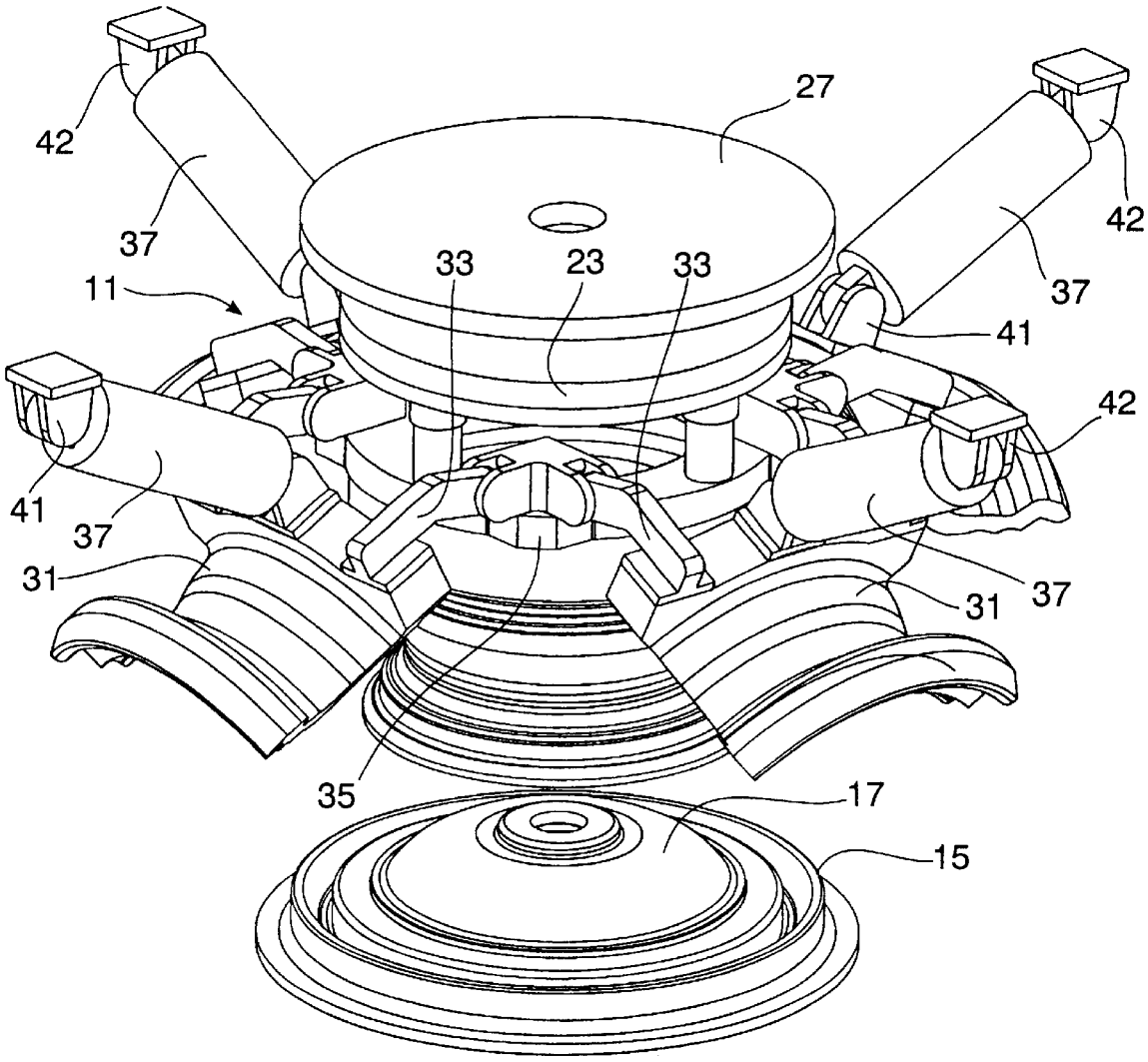
FIG. 3 is a perspective view of the apparatus of FIG. 2 with the mold opened for removal of a casting.
Figure 4:
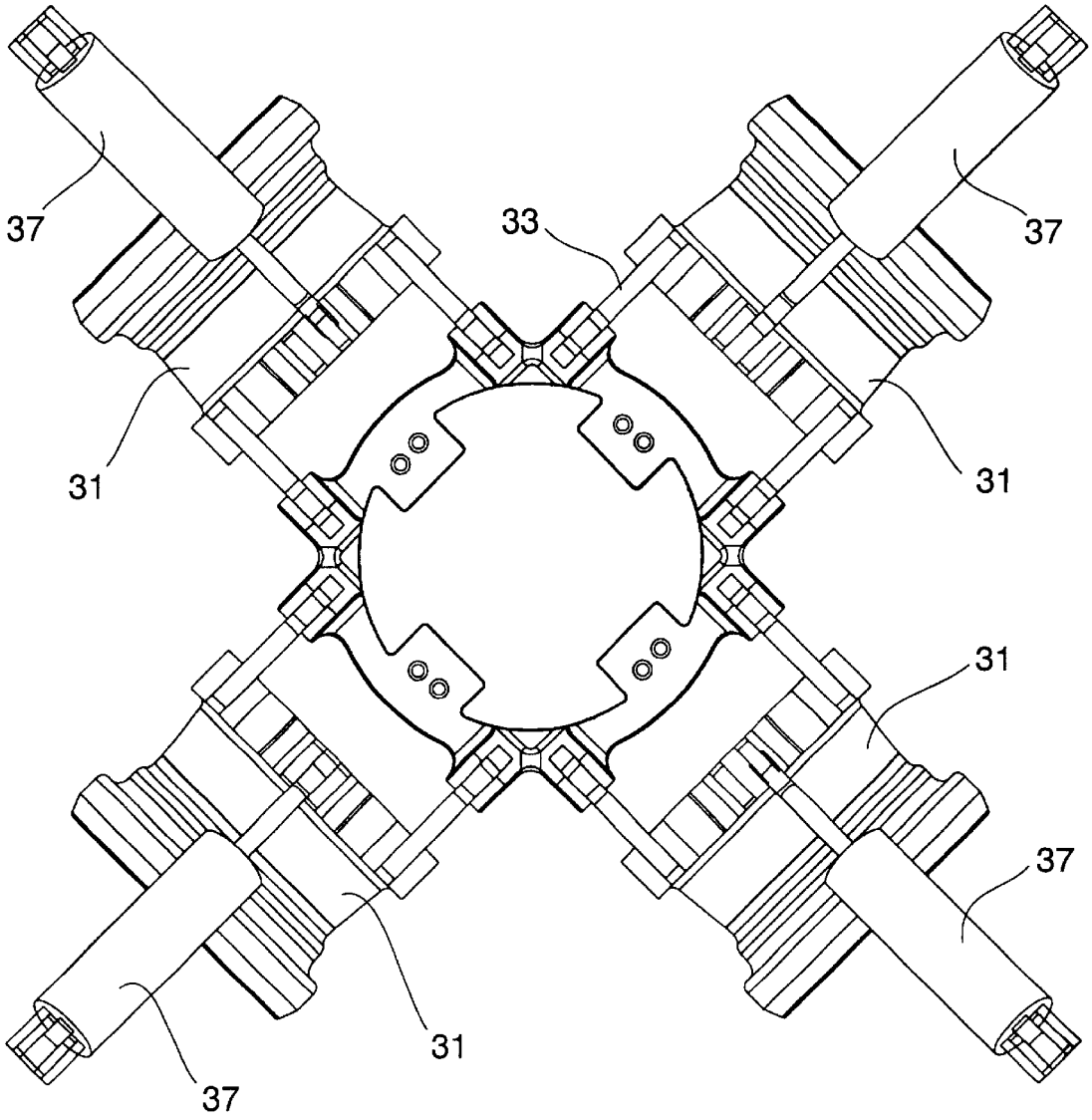
FIG. 4 is a top plan view of the apparatus of FIG. 3.

FIGS. 2, 3 and 4 show a preferred embodiment of apparatus according to the invention having an improved mechanism for positioning and moving side mold segments (side cores) in the process of closing the mold for receiving molten metal and opening the mold to remove the cast article, in this illustration an aluminum alloy automobile wheel. FIGS. 2–4 also are somewhat simplified and schematic and omit conventional elements such as hydraulic hoses and cooling fluid hoses or other cooling means for the sake of simplicity and clarity. The same reference numbers are utilized for the corresponding component parts of the apparatus in FIGS. 2–4.

FIG. 2 shows a mechanism for positioning and moving side cores according to the invention together with the multiple mold segments that make up the complete mold. FIG. 2 also shows conventional components of a top core positioning unit 11. The apparatus shown in FIG. 2 is in part supported on and secured to the bed 13 of a conventional metal article casting machine, in this example, a machine for casting aluminum alloy automobile wheels. A bottom core 17 and an associated side mold segment locator ring 15 are adapted to be affixed to the stationary bed 13 of the casting apparatus. Side mold segment locator ring 15 aids in accurate positioning of side mold segments 31 (also referred to as side cores) and thereby accurately positioning top core 19. This will be explained more fully in the explanation of the function of the apparatus. It should be noted that bottom core 17 is also referred to as a face core since it forms the outboard portion of the wheel that is visible when the wheel is mounted on the vehicle. Top core 19 forms the back or inboard surface of the wheel. It will be understood that the illustration in FIG. 2 is schematic and fragmentary to facilitate understanding of the structure of top core positioning unit 11 and associated mechanism for positioning and moving side cores.

The exterior portion of the mold is formed by side mold segments 31 which in the illustration are four in number, each forming 90° of the circumference of the wheel rim. Side mold segments 31 are also referred to as side cores. A greater or lesser number of side mold segments 31 may be employed, preferably a minimum of four but at least three.

The top core positioning unit 11, includes a locator plate 35 as well as components which assume a conventional role in the operation of the well-known conventional wheel casting machine. These components are an upper ejector plate 23, guideposts 24, ejector sleeves 25, and lower ejector plate 28. Other conventional elements typically found in such apparatus are rim ejector pin 51, hub ejector pin 53, ejector plate plug 57, and top core insert 61. The operation of such prior art metal casting apparatus components is conventional, well known, and will not be described in detail. They do not form a part of the present invention relating to positioning and moving the side cores but their function is somewhat interrelated and it will be noted that the improved apparatus for positioning and moving side cores according to the invention is compatible with and cooperates with the prior art form of top core positioning unit and the associated mechanisms for ejection of the cast article. Mounting plate 27 facilitates securing the top core positioning unit 11 to mold lifter head 29 of a conventional wheel casting machine structure.

Referring more specifically to the improved form of mechanism for positioning side cores provided by the present invention it will be noted that side mold segment 31 is aligned with respect to top core positioning unit 11 by lifter arms 33 which are pivotally attached to locator plate 35. For each of the side mold segments 31 there is provided a hydraulic cylinder 37 with a cylinder pull arm 39; a connecting head 41 is connected to lifter arms 33 and mold segment 31, allowing side mold segment 31 to be pivoted upwardly and outwardly by retraction of pivotally connected cylinder pull arm 39. Cylinder 37 is pivotally connected to mold lifter head 29 by cylinder mounting bracket 42. Mold segment 31 may or may not be integral with connecting head 41 as shown, or the mold segment 31 itself may be secured detachably to a connecting head adapter to receive it.

FIG. 2 shows the apparatus according to the invention with the mold segments closed and locked in a position to receive pressurized molten metal, which in the illustrated embodiment is fed from a furnace (not shown) below the casting machine.

Figure 5:
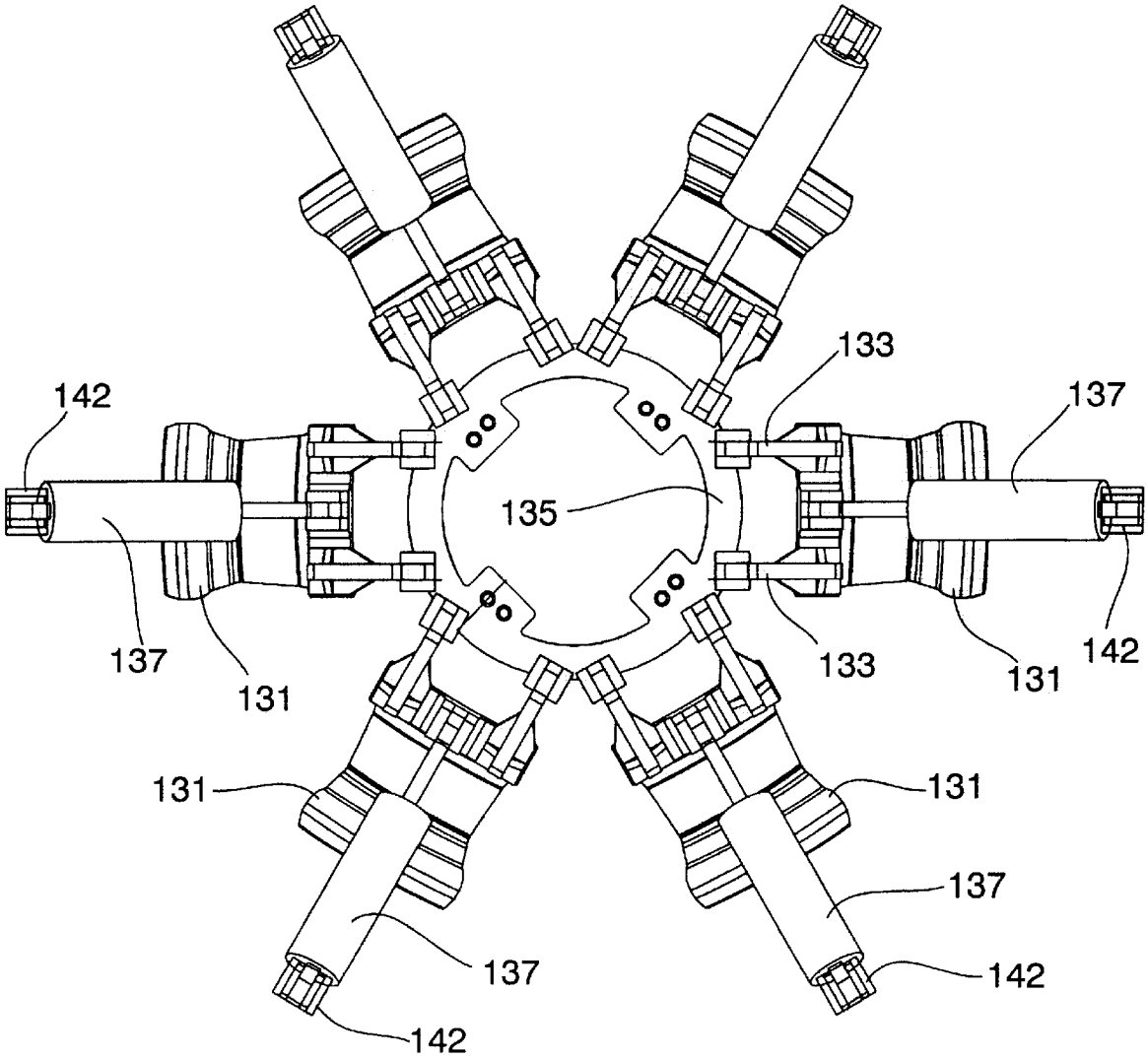
FIG. 5 is a top plan view of an alternative embodiment of the apparatus for a six-sided rather than four-sided mold configuration.

The open position of the apparatus for releasing and ejecting a molded article is shown in FIG. 3 and in FIG. 4 in a bottom plan view. Note that while there are four side mold segments illustrated, the number of side mold segments can be three or any greater number as may be convenient for a particular purpose. See FIG. 5 for a six-segment embodiment of the apparatus wherein the component parts are numbered with three digit reference numbers greater by 100 than the reference numbers in FIGS. 2–4.

Although function of the apparatus is believed to be apparent to those skilled in the art from the foregoing description and drawings, some further explanation may be helpful in understanding the advantages of the invention. Referring again to FIG. 2, once the molten metal has been fed under pressure to the mold cavity formed by the mold segments and allowed to cool, it is then necessary to operate the mechanism for positioning and moving side cores to break apart the mold by pulling away the side mold segments and separating the top core from the bottom core. Before describing the operation, however, it is important to again make note of the fact that side cores 31 (also referred to as side mold segments) have far less bulk than their counterparts in the prior art thereby greatly enhancing the ease with which the cooling of the cast article can be controlled, and if desired, can be accelerated. It should be noted in passing that it is known and common to provide numerous cooling channels for liquid within the top core and the face core whereby cooling can be controlled to improve efficiency, and more importantly to control the metallurgical characteristics of the finished product. Such channels will typically be present in the top core 19 and the face core 17 in the illustrated embodiment, but they have not been shown for simplicity and for clarity of presentation. Such cooling channels generally have not been found to be necessary for side cores 31 since they are not massive structures and are virtually totally exposed to the ambient air for ease of cooling. It should further be noted that the side cores 31 could readily be provided with cooling channels for air or any fluid medium to be supplied by flexible hoses arranged so as not to interfere with the mechanical operation of the apparatus.

It will be noted from FIG. 2 that the transition from closed and locked position of the mold to the fully open position will be started with an initial displacement at least of a small distance in the upward direction by top core positioning unit 11 in order to free side mold segments 31 from the latch function of the side mold locator ring 15 before outward and upward motion of side mold segment 31 can be effected by cylinder 37. On the other hand, a larger upper displacement or substantially total upward displacement of the top core positioning unit may be programmed to take place before cylinders 37 are actuated to pull side cores 31 from the cast article to the upward release position as shown in attachments 11, 13, and 15. If a locking element different than locator ring 15 is used, other motion sequences may be employed. A generally conventional control unit for controlling the sequence of actuation of the various mechanical actuators as well as the control of molten metal feed and of flow of cooling fluids may be employed for casting apparatus incorporating the improvement of the invention.

Once the cast article has been removed from the mold in its open condition, the procedure is repeated by cycling the mechanism for positioning and moving side molds back to the closed and locked position. In this regard, it is important to point out the effectiveness and advantages of the side mold locator ring 15 in accurately guiding and positioning both the side cores 31 and top core 19 to the molten metal receiving position. Although the latching or locking function of side mold locator ring 15 could be provided by four smaller tabs engaging the bottom of the respective side cores 31, this would do less to enhance the accuracy of positioning of the side cores 31 or of the top core 19. The side mold locator ring 15 is a complete, accurately formed circle which fully engages the accurate bottom extensions of side cores 31 thereby totally restraining the bottom portions of side cores 31 in relation to the bottom core 17. The rugged structure of lifter arms 33 also enhances the accuracy of location of locator plate 35 and hence of top core 19 relative to face core 17. The overall result of this arrangement is a substantially enhanced concentricity of the various mold segments with a substantially improved product as previously discussed.

Whereas, the present invention has been described in relation to embodiments shown and described in the drawings and specification hereof, it should be understood that other and further modifications, apart from those shown or suggested herein, may be made by those skilled in the art within the spirit and scope of this invention. The scope of the invention is not limited to such embodiments and should be determined by reference to the appended claims.

What is claimed is:

1. Molten metal casting apparatus comprising:

a vertically movable head configured to have a top core mold segment affixed thereto;

a stationary bed configured to have a bottom core mold segment affixed thereto;

at least three side mold segment connecting heads, each connecting head connected by a respective linkage to said vertically movable head to cause said connecting heads to move vertically upwardly and downwardly with the movable head while permitting pivotal movement inward and outward for each of the side mold segments;

actuators for each of said connecting heads controlled to provide inward pivotal movement of each of said connecting heads and an associated side mold segment in conjunction with downward movement of said vertically movable head to cause said side mold segments to form a closed cavity while said vertically movable head is above a fully lowered position;

said actuators being controllable to reverse said inward pivotal movement and said downward movement to pivot said connecting heads and side mold segments outward upon separation of said bottom core mold segment and said top core mold segment during raising of the movable head, thereby releasing a cast article formed in the casting mold.

2. Apparatus as recited in claim 1 wherein said connecting heads are configured to be connected to side mold segments at a position displaced from the center of the wall of each side mold segment in contact with the molten metal permitting the wall of the side mold segments in contact with the molten metal to be of uniform thickness and thereby conducive to rapid and uniform cooling of the cast article.

3. Apparatus as recited in claim 2 further including at least one latch in the form of a locator ring configured to secure each side mold segment against outward movement when the movable head is at a filly lowered position thereby locking the mold in a closed position independent of forces applied by the actuators.

4. Apparatus as recited in claim 1 further including at least one latch in the form of a locator ring configured to secure each side mold segment against outward movement when the movable head is at a fully lowered position thereby locking the mold in a closed position independent of forces applied by the actuators.

5. Apparatus as recited in claim 1 wherein said actuators comprise hydraulic cylinders mounted between said connecting heads and said vertically movable head.

6. Molten metal casting apparatus comprising:

a stationary bed;

a vertically movable head;

a bottom core mold segment configured to be affixed to the said stationary bed;

a top core mold segment configured to be affixed to said vertically movable head;

at least three side mold segments each connectable by a respective linkage to the movable head to cause them to move vertically upwardly and downwardly with the movable head while permitting pivotal movement inwardly and outwardly for each of said side mold segments;

actuators for each of said side mold segments controlled to provide inward movement of each of said side mold segments in conjunction with downward movement of said vertically movable head to form a closed cavity while such vertically movable head is above a fully lowered position;

said actuators being controllable to reverse said inward movement and said downward movement to move said side mold segments outward upon separation of said bottom core mold segment and said top core mold segment during raising of the movable head, thereby releasing a cast article formed in the casting mold;

at least one latch in the form of a locator ring configured to secure each side mold segment against outward movement when the movable head is at a fully lowered position thereby locking the mold in a closed position independent of forces applied by the actuators;

whereby castings made from molten metal by said apparatus cool uniformly, promoting optimum metallurgical properties, and said apparatus provides high production rates and short mold change times.

7. Apparatus as recited in claim 6 wherein each said respective linkage includes a pair of arms rigidly connected to each said side mold segment and pivotally connected to said movable head near said top core mold segment.

8. Apparatus as recited in claim 7 wherein said actuators comprise hydraulic cylinders mounted between said side mold segments and said movable head outboard of said top mold segment.

9. Apparatus as recited in claim 8 wherein said actuators and said linkage are connected to said side mold segments at a position displaced from the center of the wall of each side mold segment in contact with the molten metal permitting the wall of the side mold segments in contact with the molten metal to be of uniform thickness and thereby conducive to controlled and uniform cooling of the cast article.

10. Apparatus as recited in claim 6 wherein said actuators and said linkage are connected to said side mold segments at a position displaced from the center of the wall of each side mold segment in contact with the molten metal permitting the wall of the side mold segments in contact with the molten metal to be of uniform thickness and thereby conducive to controlled and uniform cooling of the cast article.

11. Molten metal casting apparatus comprising:

a stationary bed;

a vertically movable head;

a bottom core mold segment configured to be affixed to the said stationary bed;

a top core mold segment configured to be affixed to said vertically movable head;

at least three side mold segments each connectable by a respective linkage to the movable head to cause them to move vertically upwardly and downwardly with the movable head while permitting pivotal movement inwardly and outwardly for each of the side mold segments;

actuators for each of said side mold segments controlled to provide inward movement of each of said side mold segments in conjunction with downward movement of said vertically movable head to form a closed cavity;

said actuators being controllable to reverse said inward movement and said downward movement to move said side mold segments outward upon separation of said bottom core mold segment and said top core mold segment during raising of the movable head, thereby releasing a cast article formed in the casting mold;

said actuators and said linkage being connected to said side mold segments at a position displaced from the center of the wall of each side mold segment in contact with the molten metal permitting the wall of the side mold segments in contact with the molten metal to be of uniform thickness and thereby conducive to controlled uniform cooling of the cast article;

whereby castings made from molten metal by said apparatus cool uniformly, promoting optimum metallurgical properties, and said apparatus provides high production rates and short mold change times.

12. Apparatus as recited in claim 11 whereby each said respective linkage includes a pair of arms rigidly connected to each said side mold segment and pivotally connected to said movable head near said top core mold segment.

13. Apparatus as recited in claim 12 wherein said actuators comprise hydraulic cylinders mounted between said side mold segments and said movable head outboard of said top mold segment.

14. Apparatus as recited in claim 13 further including at least one latch in the form of a locator ring configured to secure each side mold segment against outward movement when the movable head is at a fully lowered position thereby locking the mold in a closed position independent of forces applied by the actuators.

15. Apparatus as recited in claim 14 further including at least one latch in the form of a locator ring configured to secure each side mold segment against outward movement when the movable head is at a fully lowered position thereby locking the mold in a closed position independent of forces applied by the actuators.

16. Molten metal casting apparatus comprising:

a stationary bed;

a vertically movable head;

a bottom core mold segment configured to be affixed to the said stationary bed;

a top core mold segment configured to be affixed to said vertically movable head;

at least three side mold segments each pivotally connected by a respective linkage to the movable head to cause them to move vertically upwardly and downwardly with the movable head while permitting independent pivotal movement inwardly and outwardly for each of the said side mold segments;

actuators for each of said side mold segments controlled to provide inward movement of each said side mold segments inwardly in conjunction with downward movement of said vertically movable head to form a closed cavity while such vertically movable head is above a fully lowered position;

said actuators being controllable to reverse to move said side mold segments outward upon separation of said bottom core mold segment and said top core mold segment. during raising of the movable head, thereby releasing a cast article formed in the casting mold;

said actuators and said linkage being connected to said side mold segments at a position displaced from the center of the wall of each side mold segment in contact with the molten metal permitting the wall of the side mold segments in contact with the molten metal to be of uniform thickness and thereby conducive to controlled and uniform cooling of the cast article;

at least one latch in the form of a locator ring circumscribing said bottom core mold segment and configured to engage tabs provided on each side mold segment to secure each side mold segment against outward movement when the movable head is at a fully lowered position thereby locking the mold in a closed position independent of forces applied by the actuators;

whereby castings made from molten metal by said apparatus cool uniformly, promoting optimum metallurgical properties, and said apparatus provides high production rates and short mold change times.

17. Apparatus as recited in claim 16 wherein each said respective linkage includes a pair of arms rigidly connected to each said side mold segment and pivotally connected to said movable head near said top core mold segment.

18. Apparatus as recited in claim 17 wherein said actuators comprise hydraulic cylinders mounted between said side mold segments and said movable head outboard of said top mold segment.

19. Apparatus as recited in claim 16 wherein said actuators comprise hydraulic cylinders mounted between said side mold segments and said movable head outboard of said top mold segment.

* * * * *